US006142529A

United States Patent [19]

Liao

[11] Patent Number: 6,142,529

[45] Date of Patent: Nov. 7, 2000

[54] STRUCTURE OF A COMBINATION FILE FOLDER

[76] Inventor: Chun-Ching Liao, P.O. Box 82-144, Taipei, Taiwan

[21] Appl. No.: 09/323,017

[22] Filed: Jun. 1, 1999

[51] Int. Cl.[7] ..... B42D 3/00

[52] U.S. Cl. ..... 281/29; 24/67 R; 281/37; 402/31; 402/46; 402/73; D19/27

[58] Field of Search ..... 281/29, 36, 37, 281/38, 21.1, 27.3; 402/73, 26, 31, 36, 46, 49, 55, 56, 70; D19/26, 27, 32; 24/67 R, 67.1

[56] References Cited

U.S. PATENT DOCUMENTS

| | | | |
|---|---|---|---|
| 2,222,547 | 11/1940 | Talley | 281/29 |
| 2,372,115 | 3/1945 | Perry, Sr. | 281/21 |
| 4,486,112 | 12/1984 | Cummins | 402/55 |
| 4,524,991 | 6/1985 | Thomas | 402/73 |
| 5,116,081 | 5/1992 | Mann, Jr. | 402/73 |
| 5,667,323 | 9/1997 | Whaley | 402/70 |

*Primary Examiner*—A. L. Wellington
*Assistant Examiner*—Monica Carter
*Attorney, Agent, or Firm*—A & J

[57] ABSTRACT

An improved structure of a combination file folder includes a pair of clip boards and a connection board which mounted together to form a file folder. The file folder is made from plastic materials and can be detached from one another. Thus, the packaging and transportation costs are greatly reduced, as the file folder does not occupy a large space. Based on the need of the size of the file folder, the change of the connection board can satisfy the needs of the consumers.

4 Claims, 4 Drawing Sheets

STRUCTURE OF A COMBINATION FILE FOLDER

BACKGROUND OF THE INVENTION a) Technical Field of the Invention

The present invention relates to an improved structure of a combination file folder, and in particular, to a file folder having two detachable clip boards and a central connection board combined together. The improved structure provides easy and convenient mass production and lowers the cost of manufacturing. The size of the combination file folder can be changed by changing the size of the connection board based on requirements.

b) Description of the Prior Art

A file folder is used to conveniently collect and keep the related information together. In conventional file folder, traditionally, thick cardboards are used as the side boards of the folder and the sizes are rade in accordance with specified requirements. In other words, the size of the file folder cannot be changed.

In manufacturing the conventional file folder, a sheet of thick cardboard or the like of a specific size is first formed and then folded. As shown in FIGS. 6 and 7, two side boards 30 and a central connection board 31 are tailored from a single sheet of board material. Based on requirements, a paper fastener 32 is mounted to one inner edge of the side boards 30 or is directly mounted onto the connection board 31 to facilitate documents collection. The conventional file folder provides a rigid side board so that the documents can be safely kept and protected. However, this conventional file folder has numerous of drawbacks. Firstly, as the size of the file folder is fixed and the file folder is made from a single sheet material, it requires to have several different connection board sizes in order to make file folder of different size. In manufacturing, it requires different molds for different size of connection boards.

As a result, the cost of manufacturing is very high. Secondly, a wider board material is required in the manufacturing of the file folder. This is due to the fact that it may be error in the cutting of the board material which causes a waste of material. Thus, this will increase the cost of production. Thirdly, the side boards have to be identical and the size varies based on the size of the required file folder, and thus, the constant changing of size of the board materials will result in a waste of materials. Lastly, due to the structure of the protruded fastener 32 mounted within the conventional file folder, these folders cannot be arranged horizontally and therefore, packaging of these file folders is difficult and it takes a large space to store. A waste of space will increase the cost of storage and transportation.

Thus, it is the main object of the inventor to design a file folder where the connection board is variable and the costs of manufacturing and transportation of the products are greatly reduced.

In accordance with one main object of the present invention, the drawbacks of the conventional file folders are thus overcome.

SUMMARY OF THE INVENTION

Accordingly, it is an object of the present invention to provide an improved structure of a combination file folder comprising a pair of clip boards and a connection board which mounted together at the vertical edges of the connection board to form a file folder. The file folder can be made from plastic materials and the clip boards can be detached from the connection board. Thus, the packaging and transportation costs of the file folder are greatly reduced. Based on the need of the size of the file folder, the change of the connection board can satisfy the needs of the consumers.

Yet another object of the present invention is to provide an improved structure of a combination file folder wherein the connection board and the clip boards can be formed from plastic materials via plastic molding process, which can thus greatly reduce the cost of manufacturing.

Another aspect of the present invention is to provide an improved structure of a combination file folder, wherein the clip boards and the central connection board are made independently, and the C-shaped fastening slots on the connection board and the knots on the edge of the clip boards can be detachably mounted. The central connection board can be replaced with a size adaptable for filing of documents as required by the users.

These and other features and advantages of the present invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENT

Figure 3:
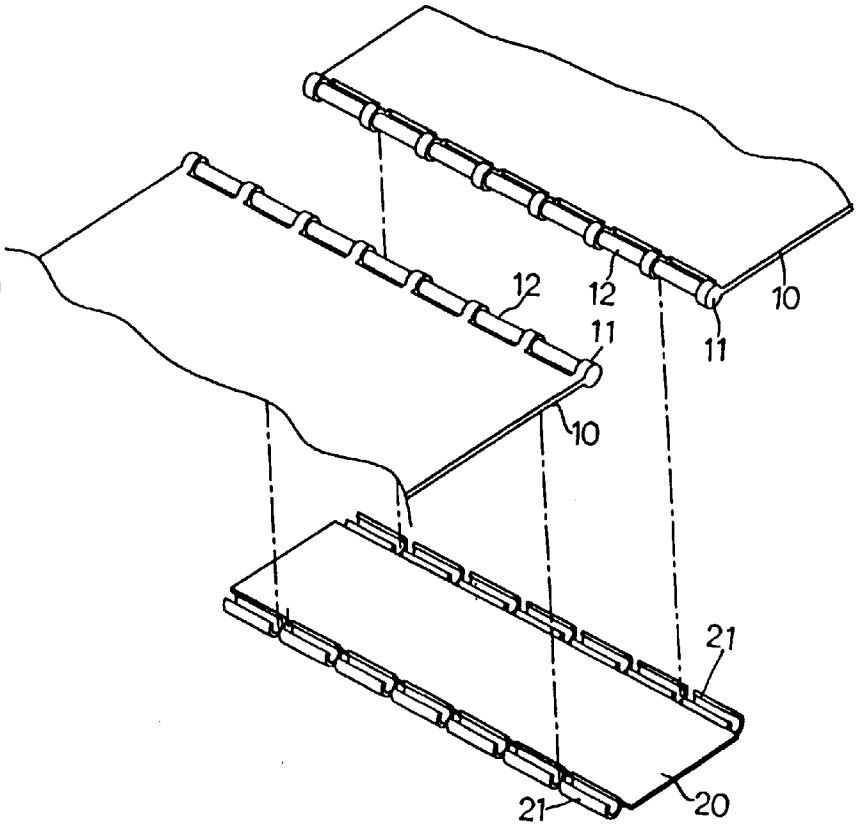
FIG. 3 is another preferred embodiment of the combination file folder of the present invention.
Figure 1:
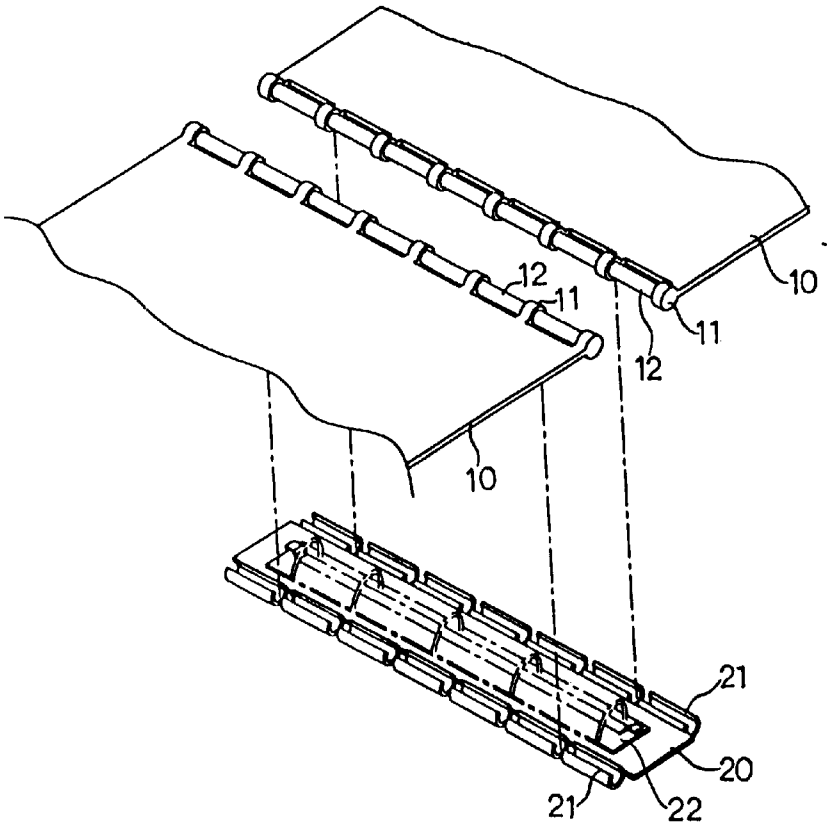
FIG. 1 is a perspective exploded view of the combination file folder of the present invention.
Figure 2A:
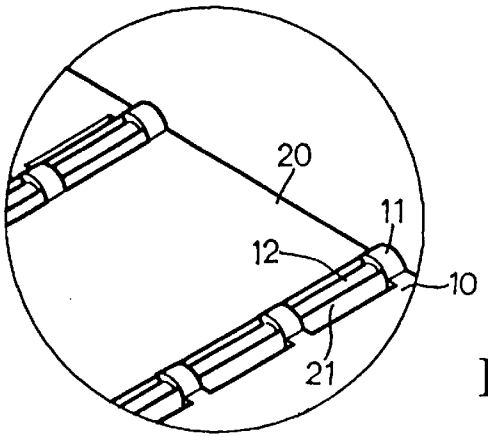
FIG. 2 is a perspective view and partially enlarged of the combination file folder of the present invention.
Figure 2:
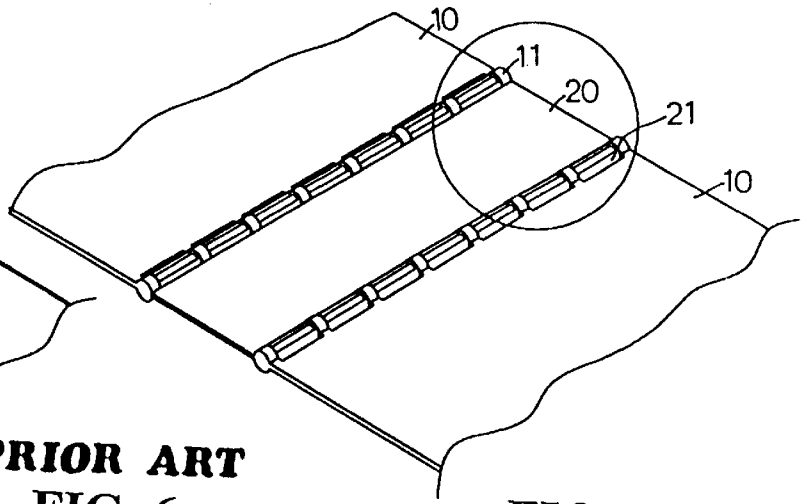
Figure 6:
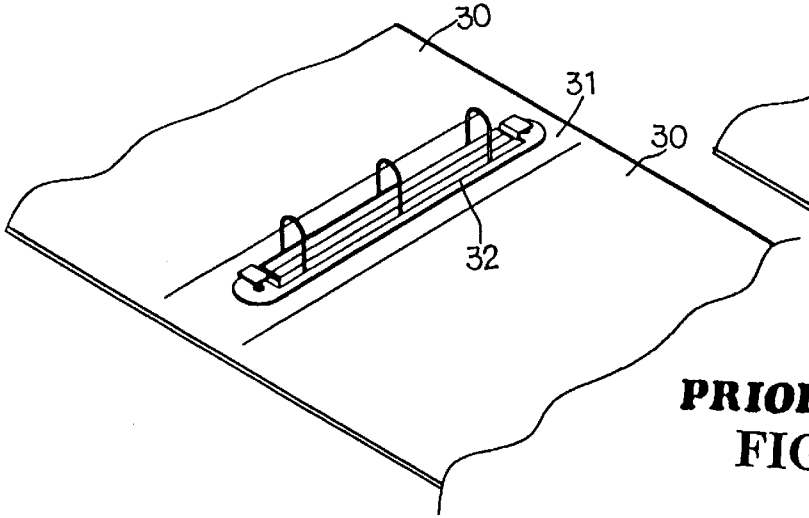
PRIOR ART FIG. 6
FIG. 6 is a schematic view of a conventional file folder when in use.
Figure 4:
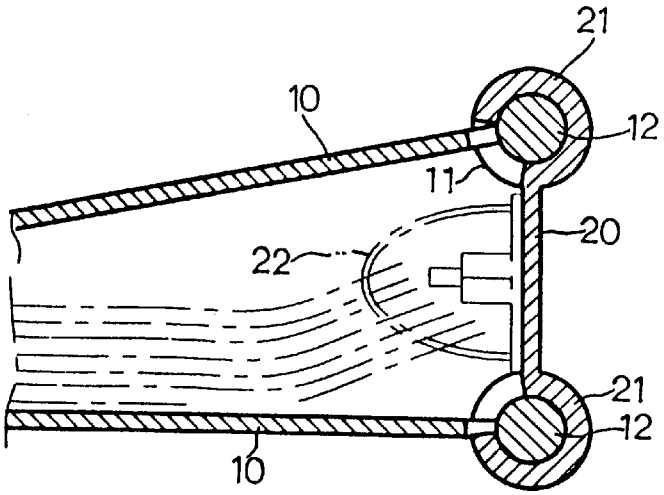
FIG. 4 is a partial top view of the combination file folder of the present invention.
Figure 5:
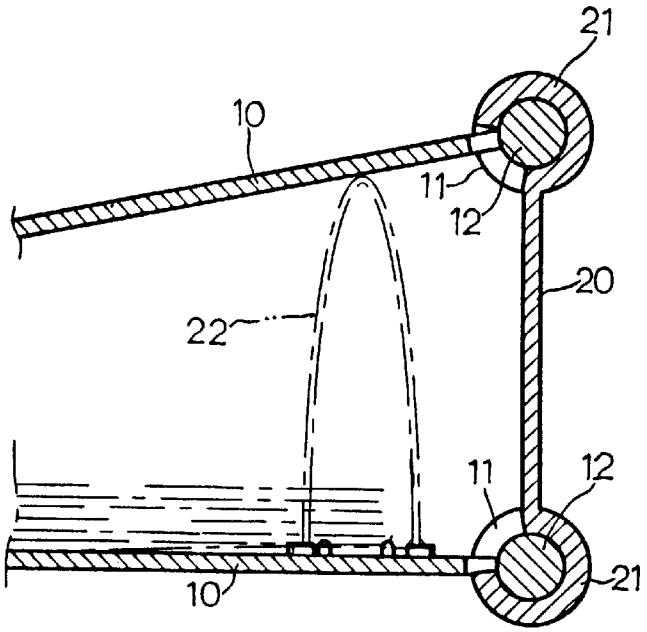
FIG. 5 is a partial top view of a further combination file folder of the present invention.
Figure 7:
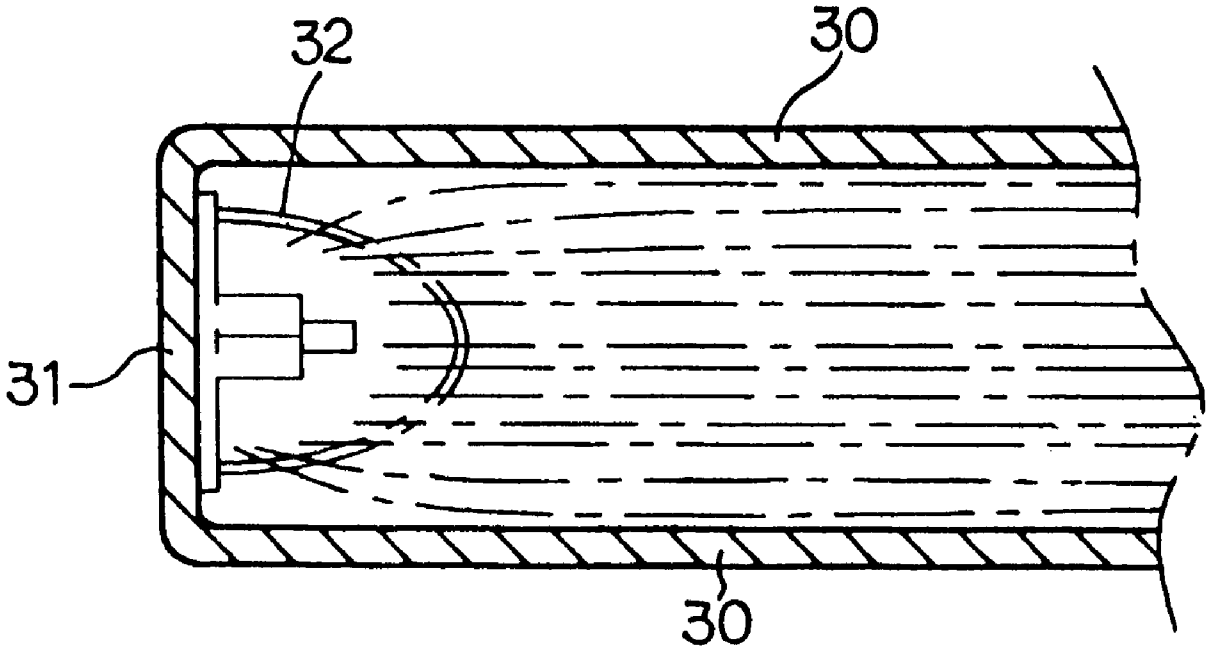
PRIOR ART FIG. 7
FIG. 7 is a partial top view of a conventional file folder.

Referring to FIGS. 1 to 5, there is show an improved structure of a combination file folder in accordance with the present invention, which comprises two corresponding identical clip boards 10, and a central connection board 20, characterized in that at one vertical edge of the clip board 10, a protruded shaft seat 11 having a plurality of slot receiving members 12 is provided and formed as a unit with the clip board 10, and the two vertical edges of the connection board 20 is provided with, a plurality of substantially C-shaped slots 21, which are correspondingly snap onto the slot receiving members of the clip boards 10. The clip boards 10 is rotatably hinged to the C-shaped slots 21 such that the clip boards 10 can be opened about the C-shaped slots 21. The slot 21 has an opening with an inward edge. In order to ensure rotatably fastening by the C-shaped slots 21, the slots 21 face upward. When in use, the edge of the clip boards 10 with the slot receiving members 12 is inserted directly into the connection board 20 at the C-shaped slots 21. A squeeze force is applied to the clip board 10 and the clip board 10 is fitted to the connection board 20. Accordingly, the clip board 10 can turn or open freely and a combination file folder is thus obtained. In accordance with the present invention, the two clip board 10 can be interchanged and the similar effect can be obtained.

In accordance with the present invention, the clip boards 10 can be mounted onto the connection board 20 of various sizes such that the sizes of the file folder can be varied. In particular, when the quantity of the documents to be filed is increased, as shown in FIG. 3, the connection board 20 can be changed into a wider board 20 without purchasing another new file folder.

Other than the unique feature of varying the size of the file folder, it is another characteristics of the present invention that the materials used for packaging of the file folders are greatly reduced. In accordance with the present invention, the two clip boards 10, the central connection board 20 and the paper fastener 22 mounted on the connection board 20 can be independently packed. This causes the packaging materials used is minimum. Accordingly, the low packaging material used lowers the cost of production and provides convenient transportation, which, in tun, lowers the cost of transportation.

In accordance with the present invention, the clip boards 20 can be made from Polypropylene material which is a recycle material and it is abundant in supply. The structure of the file folder of the present invention is also in compliance with the DIY principle such that consumers can flexibly choose the choice of colors to provide convenient filing and identification of documents.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure may be varied substantially without departing from the spirit of the invention.

I claim:

1. An improved structure of a combination file folder comprising a pair of corresponding identical clip boards; and a central connection board detachably mounted together with said clip boards at the vertical edge of the clip boards, characterized in that said clip boards and the central connection board are separately fabricated, and one vertical edge of each of the clip boards is provided with a protruded shaft seat having a plurality of slot receiving members, and the two vertical edges of the connection boards are provided with a plurality of substantially C-shaped slots, such that the slot receiving members of the shaft seat are pivotally mounted onto the C-shaped slots and the clip boards are opened or closed about the shaft seat.

2. The improved structure of a combination file folder as set forth in claim 1, wherein the position of the C-shaped slots are corresponding to the position of the slot receiving members of the shaft seat.

3. The improved structure of a combination file folder as set forth in claim 1, wherein the C-shaped slot has an opening with an inward edge.

4. The improved structure of a combination file folder as set forth in claim 1, wherein the width of the connection board is varied to adapt for the filing of documents.

* * * * *